United States Patent [19]

Larson

[11] 4,182,976

[45] Jan. 8, 1980

[54] HIGH PRESSURE SODIUM VAPOR LAMP WITH VOLTAGE RISE COMPENSATOR

[75] Inventor: Daniel A. Larson, Cedar Grove, N.J.

[73] Assignee: Westinghouse Electric Corp., Pittsburgh, Pa.

[21] Appl. No.: 922,929

[22] Filed: Jul. 7, 1978

[51] Int. Cl.[2] ..... H01J 17/34

[52] U.S. Cl. ..... 315/49; 315/58

[58] Field of Search ..... 315/49, 58, 50, 71

[56] References Cited

U.S. PATENT DOCUMENTS

| | | | |
|---|---|---|---|
| 3,851,207 | 11/1974 | McVey | 315/49 |
| 3,855,494 | 12/1974 | Plagge | 313/249 X |

*Primary Examiner*—Aflred E. Smith
*Assistant Examiner*—Charles F. Roberts
*Attorney, Agent, or Firm*—R. S. Lombard

[57] ABSTRACT

A high pressure sodium vapor lamp having an elongated light-transmitting refractory arc tube with closure members sealing each end of the arc tube. An elongated hollow refractory metal member of predetermined length and surface area projects from the arc tube and is sealed through one of the closure members. The interior of the hollow metal member opens into the interior of the arc tube and the projecting end of the hollow metal member is sealed. During the operation of the lamp, the hollow metal member acts as a condensing repository for excess discharge sustaining filling which is not vaporized since the coolest spot of the hollow metal member is at a temperature less than the arc tube. The hollow metal member is provided on the outer surface with a radiation-emissive and electrical-insulating means, and a resistive-heater member is affixed to the exterior of the hollow metal member and in thermal contact with the radiation-emissive and electrical-insulating means. The resistive-heater member generates a predetermined power dissipation when carrying the normal operating current of the lamp to provide a heating effect for the metal member. Voltage rises in the lamp are normally encountered during prolonged operation and typically cause the lamp current to decrease, reducing the heating provided by the resistive-heater member which at least in part compensates for the tendency for increased voltage to be developed across the arc tube.

6 Claims, 2 Drawing Figures

HIGH PRESSURE SODIUM VAPOR LAMP WITH VOLTAGE RISE COMPENSATOR

BACKGROUND OF THE INVENTION

This invention relates to high pressure sodium vapor lamps and, more particularly, to a lamp that includes improved means for compensating for the tendency of the voltage across the arc tube of the lamp to increase over the lamp life due to elevated "cool" spot temperature. Two factors in particular cause voltage rise in the lamp. The more prevalent factor is a gradual increase in "cool" spot temperature which controls lamp vapor pressure to a large degree and therefore the voltage. The second factor is a gradual loss of sodium due to reaction with the lamp components or by diffusion through the seal. Voltage rise is undesirable, because when the voltage increases to a certain value the lampe will extinguish.

One such compensating means disclosed in U.S. Pat. No. 3,851,207 dated Nov. 26, 1964 issued to McVey, comprises a high-intensity sodium vapor arc lamp utilizing a slender tubular envelope of alumina ceramic having self-heating electrodes mounted at opposite ends and containing an excess pool of sodium mercury amalgam at the "cool" spot in the lower end. The electrode at the lower end includes a resistive heater portion and lamp current flowing therethrough provides supplementary heat to the amalgam pool varying according to lamp current. This design counters the tendency to arc voltage rise with life and reduces the sensitivity of the lamp to radiant energy reflected back from the fixture.

SUMMARY OF THE INVENTION

This invention provides a high-pressure sodium vapor lamp including an elongated light-transmitting refractory arc tube enclosing a discharge-sustaining filling of sodium or mercury and sodium as amalgam in predetermined amount and predetermined atom ratio together with a predetermined pressure of inert ionizable starting gas. The arc tube also includes electrodes operatively positioned within the arc tube proximate each end thereof, closure members sealing each end of the arc tube, and an elongated hollow refractory metal member of predetermined length and surface area projecting from an end of the arc tube. The hollow refractory metal member is sealed through one of the closure members. The interior of the hollow metal member opens into the interior of the arc tube and the hollow metal member is sealed at the projecting end thereof.

The lamp also includes a light-transmitting outer envelope with arc tube supporting means within the outer envelope for supporting the arc tube in predetermined position therein. Power adaptor means is affixed to the exterior surface of the outer envelope for connection to a power source. Lead-in members are sealed through the outer envelope connecting the electrodes to the power adaptor means. During the operation of the lamp, the coolest spot of the elongated hollow metal member is at a temperature less than the arc tube, thereby causing the hollow metal member to act as a condensing repository for excess discharge-sustaining filling which is not vaporized.

The hollow metal member has provided on the outer surface thereof a radiation-emissive and electrical-insulating means. The hollow metal member also has a resistive-heater member proximate the exterior surface thereof and in thermal contact with the radiation-emissive and electrical-insulating means. The resistive-heater is connected in circuit between the proximate electrode adjacent the one closure member and one of the lead-in members. The resistive-heater member has a predetermined power dissipation when carrying the normal operating current of the lamp to heat the metal member. During prolonged operation of the lamp, voltage rises as normally encountered therewith and which tend to decrease the normal operating current for the lamp, result in less power dissipation in the resistive-heater member. This decreases the heating provided by the resistive-heater member for the hollow metal member and thus at least in part compensates for the tendency of increased voltage to be developed across the arc tube.

BRIEF DESCRIPTION OF THE DRAWINGS

For a better understanding of the invention, reference may be had to the preferred embodiment, exemplary of the invention, shown in the accompanying drawings, in which.

DESCRIPTION OF THE PREFERRED EMBODIMENT

Figure 1:
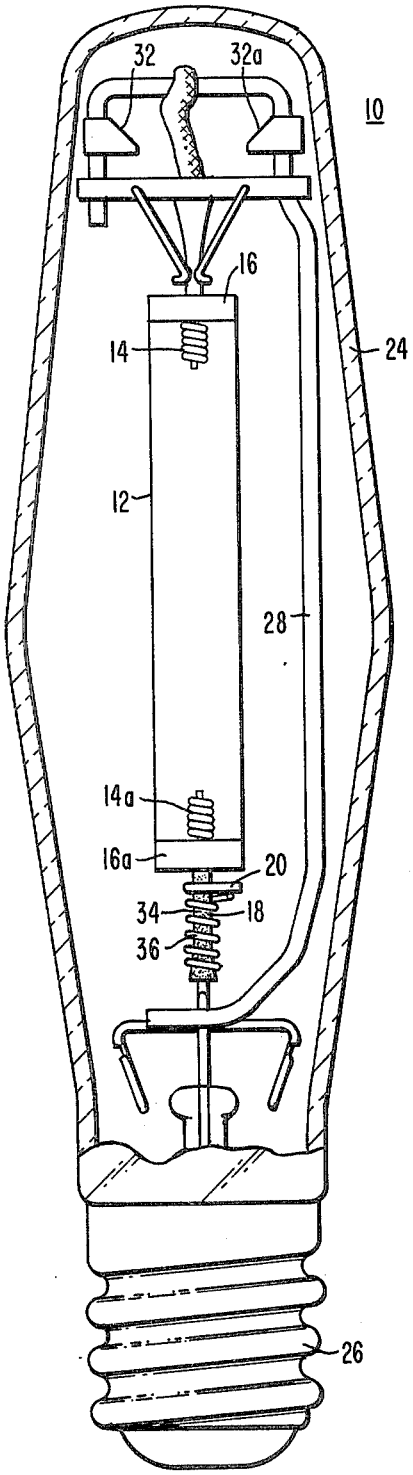
FIG. 1 is a plan view showing a high-pressure sodium vapor lamp with the resistive-heater member proximate the elongated hollow metallic member, in accordance with the present invention.

In FIG. 1 is shown a high-pressure sodium vapor lamp 10 including an elongated light-transmitting refractory arc tube 12. The arc tube 12 is made of a ceramic body capable of withstanding the attack of sodium vapor at high temperatures such as single crystal alumina or polycrystalline alumina, as is well known in the art. The arc tube 12 encloses a discharge-sustaining filling of sodium or mercury and sodium as amalgam in predetermined amount, such as about 30 mg. for a 400 watt lamp, and predetermined atom ratio of sodium to mercury of about 2.3:1, for example, together with a predetermined pressure of inert ionizable starting gas such as 20 torrs of xenon. Electrodes 14, **14*a* are provided which are typically made of tungsten with dibarium calcium tungstate emission material and are operatively positioned within the arc tube proximate the ends thereof. Closure members 16, 16*a* are sealed to the ends of the arc tube 12**.

Figure 2:
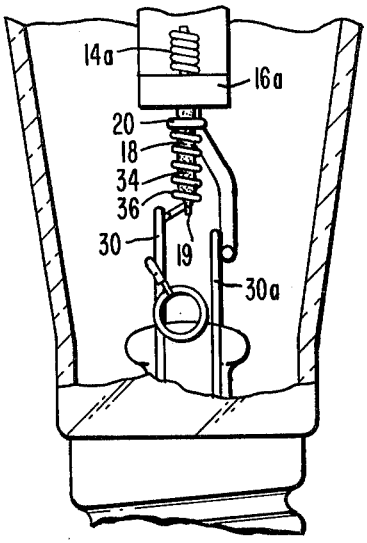
FIG. 2 is an enlarged fragmentary side view showing details of the resistive-heater member arrangement.

Referring to FIG. 2, there is illustrated an elongated hollow refractory metal member 18 of predetermined length and surface area projecting from an end of the arc tube and sealed through one of the closure members **16*a*. The refractory metal member 18 can be made of niobium or tantalum, for example. The closure members 16, 16*a* are also normally constructed of niobium, although alumina end caps can be used. The assembly of the refractory metal member 18 through the closure member 16*a* can be accomplished as described in U.S. Pat. No. 3,855,494 to Plagge. A looped lead-in connector 20 may be affixed to the refractory metal member 18 proximate the closure member 16*a* as described in the foregoing U.S. Pat. No. 3,855,494. The interior of the hollow metal member 18 opens into the interior of the arc tube 12 and the hollow metal member 18 is sealed at the projecting end 19** thereof, typically by resistance welding.

The lamp 10 further includes a light-transmitting outer envelope 24 of hard glass having power adaptor means 26, such as a screw-type base, affixed to the exterior surface thereof for connection of the lamp 10 to a power source. An arc tube supporting frame or means 28 is provided within the outer envelope 24 for supporting the arc tube 12 in predetermined position therein. Lead-in members 30, 30*a* are sealed through the outer envelope 24, such as by means of a conventional stem press 31, and connect the electrodes 14, 14*a* to the power adaptor 26. Lead-in conductor 30*a* is connected to the arc tube supporting frame 28. The arc tube supporting frame 28 is supported at its upper end within the envelope 12 by a pair of resilient spring members 32, 32*a* which position and retain the arc tube supporting frame 28 in a central location within the outer envelope 12. The lamp as described thus far is generally conventional.

During the operation of the lamp 10, the coolest spot of the elongated hollow metal member 18 is at a temperature less than the arc tube which causes the hollow metal member 18 to act as a condensing repository for excess discharge-sustaining filling which is not vaporized. The cool spot determines the lamp vapor pressure and the lamp voltage. It is desirable to maintain the cool spot temperature as nearly constant as possible during the life of the lamp to prevent the previously mentioned tendency of the lamp for voltage rise as it is operated which can be caused by a variety of factors such as arc tube end blackening or sodium cleanup. In accordance with the present invention, the hollow metal member 18 is provided on the outer surface thereof with a radiation-emissive and electrical-insulating means or coating 34 and a resistive-heater member 36 is affixed proximate the hollow metal member 18 and is in thermal contact with the radiation-emissive and electrical-insulating coating 34. The resistive-heater 36 is connected in circuit between electrode 14*a* proximate the closure member 16*a* and the lead-in member 30. The resistive-heater 36 exhibits a predetermined power dissipation when carrying the normal operating current of the lamp 10 to provide a heating effect for the metal member 18. During prolonged operation of the lamp, voltage rises as normally encountered therewith which tend to decrease the normal operating current for the lamp, result in less power ($I^2R$) dissipation in the resistive-heater member, thereby resulting in a decrease of the heating provided for the hollow metal member 18 and limiting the increase in temperature of the excess discharge-sustaining filling deposited in the hollow metal member. This at least in part compensates for the tendency for increased voltage to be developed across the arc tube 12.

The surface area of the hollow metal member 18 and the emittance of the radiation-emissive and electrical-insulating coating 34 each affect the amount of power dissipated by the hollow metal member 18. By increasing the surface area of the hollow metal member 18, or the emittance of the radiation-emissive and electrical-insulating coating 34, or both, to achieve a predetermined increase in temperature of the cool spot requires an increase in the power supplied to heat the cool spot, i.e., it requires an increase in heat flow to the cool spot to achieve the temperature increase. Simply applying the radiation-emissive and electrical-insulating coating 34 to the hollow metal member 18, or increasing the surface area thereof will help inhibit the voltage rise. However, this presents the problem of obtaining the nominal initial voltage desired for lamp operating voltage, typically 100 volts, since the additional radiation dissipated will lower the cool spot temperature below the desired value, which is typically 700° C. By utilizing the resistive-heater member 36, the loss due to increased radiation can be compensated for and the nominal operating voltage be obtained. By utilizing the present invention, during the life of the lamp, the voltage rise will not be as great as previously encountered, since a given change in the factors causing voltage rise will not raise the cool spot temperature as much because of its greater thermal radiation capacity and any voltage increase which does occur is minimized since it results in a reduction in lamp current and therefore, in the power input to the resistive-heater 36, thereby reducing its contribution to the heating of the cool spot. The use of the present invention with a resistive-heater member 36 dissipating 4 watts typically results in a voltage rise of about 25% of the voltage rise encountered previously and even though the power consumed by resistive-heater 36 represents an initial efficacy loss, by maintaining the lamp voltage and sodium vapor pressure near the desired operating range results in improved efficacy over the life of the lamp and more constant light output. In addition to reducing voltage rise, the present construction also serves to narrow the spread of voltage found in lamp manufacture and brings many normally out-of-tolerance lamps back into the desired operating voltage range.

As one example of the invention, a 150 watt, 100 volt single crystal sapphire arc tube 12 has a hollow metal member 18 made of niobium having an 11 mm length and 15 mil (0.381 mm) thickness. The radiation-emissive and electrical-insulating coating 34 has the general characteristics of a full radiator and comprises a fired frit of 49.5 wt.% CaO-43.3 wt.% $Al_2O_3$-7.2 wt.% $SiO_2$ and is applied by dispersing 1000 gms. of the frit in 350 cc. of a mixture of an adhesive and a solvent such as cellulose acetate (3.5% by volume) and amyl acetate and dipping the hollow metal member 18 in the solution and firing at 1400° C. for 3 minutes, for example. The conductive-heater consists of 10 turns of 10 mil (0.254 mm) tantalum wire wound on the hollow metal member 18 which has an outside diameter of 0.125 in. (3.175 mm) and surface area of 1.10 $cm^2$. The resistive-heater 36 is connected at one end to lead-in member 30 and at the other end to looped lead-in 20. When the lamp is operated on a 150 watt high-pressure sodium lamp ballast at normal input voltage, the lamp operates at 68 volts with the resistive-heater 37 shorted and 114 volts with the resistive-heater in the circuit. In the latter case, the power dissipated by the resistive-heater 36 is 4.4 watts.

In another example, a 400 watt lamp with a 15 mm long niobium hollow metal member having an outside diameter of 0.125 in. (3.175 mm), a surface area of 1.5 $cm^2$ and a like radiation-emissive and electrical-insulating coating 34 as in the previous example, is wound with a resistive-heater consisting of 3.375 in. (8.573 cm) of 20 mil (0.508 mm) tantalum wire. This lamp is compared with a standard lamp when both are operating in open air and then in identical aluminum heat-reflective can-like reflectors to simulate hot-fixture operation. The results are as follows:

| | Open Air Operation | Aluminum Can Operation | |
|---|---|---|---|
| Present Lamp | 104 V | 115 V | = 11 V rise |
| Standard Lamp | 87 V | 134 V | = 47 V rise |

When compared for change in operating voltage at ±10% variation in 220 mains input voltage, the results are as follows:

| | Input (V) | Power (W) | Operating Voltage | Current (a) |
|---|---|---|---|---|
| Present Lamp | 200 | 310 | 83 | 4.35 |
| | 200 | 400 | 101.5 | 4.65 |
| | 240 | 500 | 118.5 | 5.0 |
| Standard Lamp | 200 | 295 | 77 | 4.5 |
| | 220 | 370 | 87 | 4.95 |
| | 240 | 495 | 117 | 4.98 |

The change in operating voltage of the present lamp is about 25 volts versus about a 30 volt change for the standard lamp as a result of the indicated input voltage variation.

I claim:

1. A high pressure sodium vapor lamp comprising:

a. an elongated light-transmitting refractory arc tube enclosing a discharge-sustaining filling of sodium or mercury plus sodium as amalgam in predetermined amount and predetermined atom ratio together with a predetermined pressure of inert ionizable starting gas, electrodes operatively positioned within said arc tube proximate each end thereof, closure members sealing each end of said arc tube, and an elongated hollow refractory metal member of predetermined length and surface area projecting from an end of said arc tube and sealed through one of said closure members with the interior of said hollow metal member opening into the interior of said arc tube, and the end of said hollow metal member which projects from said arc tube being sealed;

b. a light-transmitting outer envelope, arc tube supporting means within said outer envelope for supporting said arc tube in predetermined position therein, power adaptor means affixed to the exterior surface of said outer envelope for connection to a power source, lead-in members sealed through said outer envelope and connecting said electrodes to said power adaptor means, and during the operation of said lamp the coolest spot of said elongated hollow metal member being at a predetermined temperature less than said arc tube to cause said hollow metal member to act as a condensing repository for excess discharge-sustaining filling which is not vaporized; and c. said hollow metal member having carried on the outer surface thereof a radiation-emissive and electricalating means, a resistive-heater member affixed proximate the exterior surface of said hollow metal member and in thermal contact with said radiation-emissive and electrical-insulating means, said resistive-heater member connected in circuit between the said electrode which is proximate said one closure member and one of said lead-in members and said resistive-heater member generating a predetermined power dissipation therein when carrying the normal operating current of said lamp to provide a heat input to said hollow metal member; whereby during prolonged operation of said lamp, voltage rises as normally encountered therewith and which tend to decrease the normal operating current for said lamp, result in less $I^2R$ power dissipation in said resistive-heater member, thereby to decrease the heating of said hollow metal member by said resistive-heater member and thus at least in part compensate for the tendency for increased voltage to be developed across said arc tube.

2. The lamp of claim 1, wherein said elongated hollow refractory metal member is niobium.

3. The lamp of claim 1, wherein the radiation-emissive and electrical-insulating means comprises a fired frit of $CaO—Al_2O_3—SiO_2$.

4. The lamp of claim 1, wherein said resistive-heater member is fabricated of tantalum.

5. The lamp of claim 3, wherein said CaO is 49.5 wt.% of said frit, said $Al_2O_3$ is 43.3 wt.% of said frit, and said $SiO_2$ is 7.2 wt.% of said frit.

6. The lamp of claim 1, wherein said radiation-emissive and electrical insulating means has the general characteristics of a full radiator.

* * * * *